United States Patent [19]

Levy

[11] Patent Number: 4,729,148

[45] Date of Patent: Mar. 8, 1988

[54] CARRIER FOR FLEXIBLE CLOSURE

[76] Inventor: James F. Levy, 1010 Whaley St., Columbia, S.C. 29201

[21] Appl. No.: 922,995

[22] Filed: Oct. 24, 1986

[51] Int. Cl.[4] ..... E05D 15/00

[52] U.S. Cl. ..... 16/87.2; 16/95 D; 16/97

[58] Field of Search ..... 16/87.2, 94 D, 87.4 R, 16/87.6 R, 95 D, 89, 93 D, 93 R, 95 R, 96 R, 96 D, 97, 102; 160/123, 124, 345, 346, 347; D6/524; D25/49, 58; 24/378; 4/558, 610

[56] References Cited

U.S. PATENT DOCUMENTS

| | | | |
|---|---|---|---|
| 2,761,150 | 9/1956 | Kellogg | 16/87.6 R |
| 3,550,184 | 12/1970 | Hachtel | 16/87.2 |
| 3,596,306 | 8/1971 | Wachenheimer | 16/87.2 |
| 3,637,084 | 1/1972 | Vitz | 16/94 D |
| 4,166,494 | 9/1979 | Utting | 16/97 |
| 4,217,676 | 8/1980 | Terrones | 16/87.2 |

FOREIGN PATENT DOCUMENTS

| | | | |
|---|---|---|---|
| 1246188 | 8/1967 | Fed. Rep. of Germany | 16/87.2 |
| 2327346 | 12/1974 | Fed. Rep. of Germany | 16/93 D |

*Primary Examiner*—Nicholas P. Godici
*Assistant Examiner*—G. M. Reid
*Attorney, Agent, or Firm*—Brady, O'Boyle & Gates

[57] ABSTRACT

A wheeled track-mounted carrier in one use mode supports a shower curtain through a color-coordinated button having a shank received through a grommet on the shower curtain. The button is removably connected with the body of the carrier which is suspended removably from the axle of a dual wheel track follower. In a second use mode, the color-coordinated button is separated from the body of the carrier and a pair of spring arms previously held in inactive positions on the body are released and are inserted upwardly through tubular pockets of a tape which is stitched at intervals to a drapery whereby the drapery is conveniently suspended from the track-mounted carrier. Multiple carriers are employed along a length of shower curtain, drapery or other hanging flexible closure.

11 Claims, 9 Drawing Figures

CARRIER FOR FLEXIBLE CLOSURE

BACKGROUND OF THE INVENTION

1. Technical Field:

The present invention relates to a wheeled carrier for hanging flexible closures, and more particularly relates to a carrier which, in one use mode, supports a color-coordinated shower curtain or the like and, in another use mode, supports draperies or the like.

2. The Prior Art:

The most common type of support for a shower curtain consists of an overhead horizontal support bar on which shower curtain suspension hooks or rings are slidably mounted with the hooks or rings engaging through apertures formed in the shower curtain near its top edge. There is a tendency for the shower curtain to separate from the suspension hooks during usage which necessitates frequent re-attaching of the curtain to the hooks, which is inconvenient.

Pleated draperies are generally held by pins which must be inserted through the pleated portions of the drapery and the pins engage through eyelets forming a part of the customary traverse rod. The installation of drapery pins is difficult and timeconsuming. Furthermore, the pins are rarely installed in precise locations and consequently most expensive draperies do not show as well as they could if better installation procedures were available.

Accordingly, it is the objective of the present invention to overcome the above-stated deficiencies of the prior art relating to both shower curtain and drapery support means. The invention is also applicable to hospital privacy curtains including single use disposable paper curtains.

A further object is to provide a wheeled carrier which can be used selectively for the support of a shower curtain or for the support of draperies.

Another object of the invention is to provide a tape having tubular pockets which can be permanently installed on draperies by stitching, the tubular pockets of the tape receiving drapery suspension arms on the wheeled carrier in one use mode thereof. The arrangement permits the draperies to be easily and quickly removed for washing or dry cleaning with the pocketed tape permanently attached thereto. After cleaning, the draperies can be rehung conveniently in the same precise location previously occupied by them, due to the construction of the carrier forming the subject matter of this invention.

Other features and advantages of the invention will become apparent to those skilled in the art during the course of the following description.

SUMMARY OF THE INVENTION

The present invention is best summarized as a carrier having a body portion provided at its opposite ends with hooklike terminals having restricted entranceways through which axle portions of a dual wheel unit and a shower curtain suspension element may be removably snap-locked into engagement with the hook-like terminals. A pair of spring arms on the body portion are biased toward separated divergent positions but can be held releasably in retracted substantially parallel positions by keepers on the body portion. The entire carrier and its components are readily moldable from available plastics.

BRIEF DESCRIPTION OF DRAWING FIGURES

DETAILED DESCRIPTION

Figure 1:
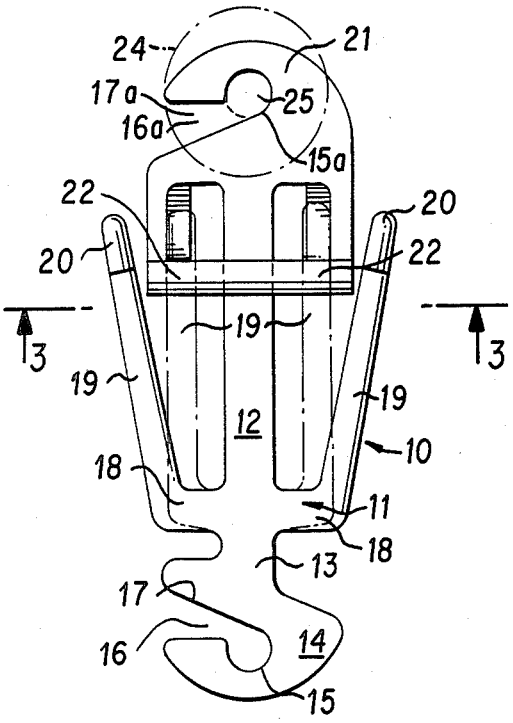
FIG. 1 is a side elevation of a carrier for a flexible closure according to the present invention.
Figure 2:
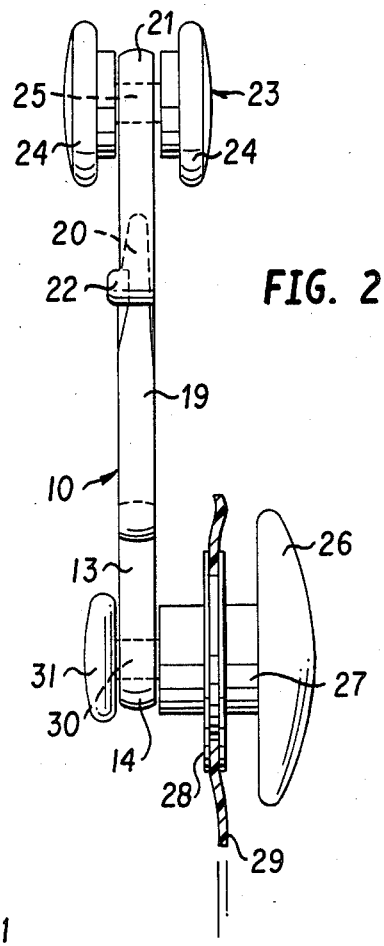
FIG. 2 is an elevational view of the carrier taken at right angles to FIG. 1.
Figure 3:
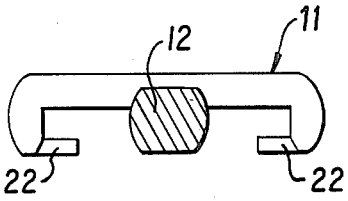
FIG. 3 is a horizontal section taken through the carrier body portion substantially on line 3—3 of FIG. 1.
Figure 4:
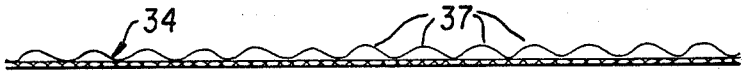
FIG. 4 is an edge elevation of a drapery support tape.

Referring to the drawings in detail, wherein like numerals designate like parts throughout, a dual purpose wheeled carrier 10 for flexible closures, such as shower curtains and draperies, includes a body portion 11 having a central bar 12. At its lower end, the body portion 11 carries a short extension 13 as an extension of the bar 12, and a lower hook terminal 14 is carried by the extension 13 in a vertical plane. The lower hook terminal has a center cylindrically formed opening 15 having a restricted entrance 16 defined by a tapered entranceway 17, for a purpose to be described.

A pair of short horizontal extensions 18 on opposite sides of the central bar 12, near and above the hook terminal 14, carry upwardly extending outwardly biased divergent spring arms 19 used to support draperies in a manner to be fully described. The upper end portions of the spring arms 19 have enlarged heads 20, as shown.

The carrier body portion 11 at its upper end includes a hook terminal 21 similar to the hook terminal 14 and being disposed in a common vertical plane therewith and being connected to the central bar 12. A pair of laterally opposing keepers 22 for the spring arms 19 are provided on the body portion 11 on opposite sides of the central bar 12 and somewhat below the hook terminal 21. These keepers 22 allow the two spring arms 19 to be drawn together into parallelism as shown in broken lines in FIG. 1 where the arms are held releasably by the keepers 22 until it is desired to release the spring arms for use in the support of draperies, as will be further described. The entire body portion 11 can be molded from plastics material as a unit.

The carrier 10 further comprises a dual wheel assembly 23 including a pair of spaced wheels 24, one on each side of the body portion 11. The wheels 24 are united with a short cylindrical axle 25 which is sized to fit the cylindrically formed opening 15*a* of the hook terminal 21 after passing through the tapered entranceway 17*a* and restricted entrance 16*a*. The axle is snaplocked in the opening 15*a* but is removable therefrom due to the resiliency of the plastics material from which the carrier is made.

The carrier further comprises at its lower end a circular button 26 which can be color-coordinated with any shower curtain. It includes a cylindrical shank 27 adapted to be received through any grommet 28 of a conventional shower curtain 29 and a reduced diameter short axle 30 carrying an enlarged head 31. The axle 30 can be snap-locked removably in the opening 15 of the lower hook terminal 14, shown in FIG. 1.

Figure 6:
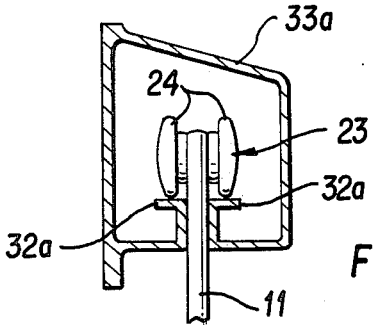
FIG. 6 is a cross-sectional view of a support and guide track for the carrier.

The dual wheel assembly 23 is adapted to run on the horizontal rails 32 of a round cross-section hollow support bar 33 which can be installed at a desired elevation in any desired manner. Alternatively, the support bar may be formed other than round in cross-section, FIG. 6, where the bar 33*a* is a modified rectangle having internal tracks 32*a* for the dual wheel unit 23. The tracks 32 and 32*a* are spaced apart so that the carrier body portion 11 may travel between them.

A drapery support tape 34 of required length is provided, and this tape at regularly spaced intervals has double woven areas 35 which enable the tape to be stitched permanently to a drapery 36 at the proper elevation thereon. The tape 34 is provided along its length with a series of half-round tubular tape segments 37, adjacent pairs of which can receive the spring arms 19 of the carrier 10, when the latter are released from their keepers 22.

Figure 7:
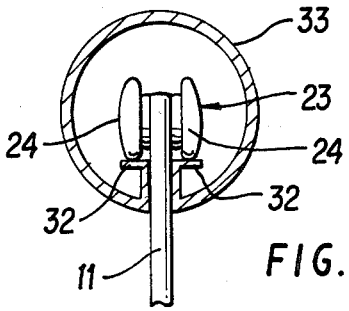
FIG. 7 is a similar view of a modified type of track.

When the carrier 10 is to be used for supporting a shower curtain 29 or the like, the spring arms 19 are engaged with their keepers 22 and are held in parallelism, as shown in broken lines in FIG. 1. At this time, the arms 19 serve no function. The dual wheel assembly 23 is properly connected to the body portion 11 and engaged within the support bar 33, FIG. 7. The shank 27 of color-coordinated button 26 is inserted through a shower curtain grommet 28, and the axle 30 is engaged with the lower hook terminal 14. It will be understood that as many of the wheeled carriers 10 are employed as there are grommets 28 or openings in a particular shower curtain.

Figure 5:
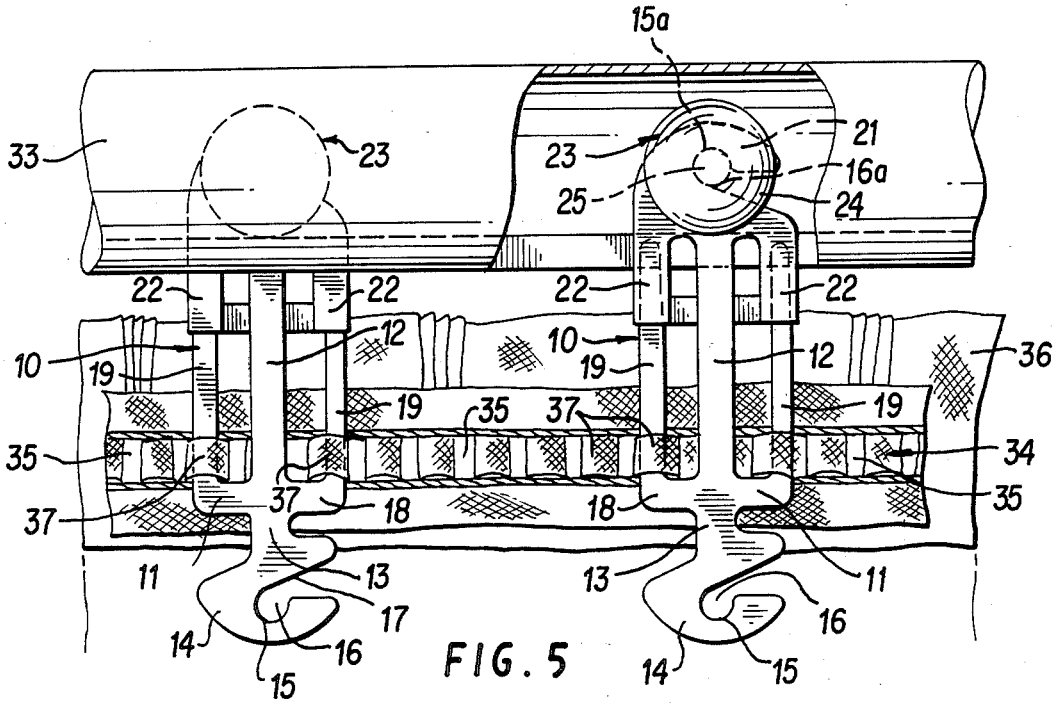
FIG. 5 is a fragmentary side elevation of a pleated drapery having the support tape installed thereon and showing the support tape engaged with the drapery suspension spring arms of the carrier.

When the device is used to support a drapery 36 having the tape 34 attached thereto, FIG. 5, the button 26 is separated from the hook terminal 14 and is not used. The spring arms 19 are released from the keepers 22 and are inserted manually upwardly through adjacent tape segments 37 and then the spring arms are re-engaged with the keepers 22. The dual wheel assembly 23 functions in the same manner relative to the drapery 36 as it does relative to the shower curtain 29. In both cases, the carrier body portion 11 hangs vertically from the dual wheel assembly 23 while the latter is stationary or while traversing the rails 32. It will be understood that as many of the wheeled carrier assemblies 10 as needed are employed to support a drapery 36 of any length, and the tape 34 extends continuously along the upper portion of the drapery, forming a permanent attachment thereto.

This invention provides a more convenient, precise and consistent support means for draperies without the awkward and imprecise task of installing drapery pins. The arrangement allows the drapery to be removed easily from the carriers 10 for laundering or dry cleaning, following which the drapery can be rehung with convenience in exactly the same location and elevation which it previously occupied.

Figure 8:
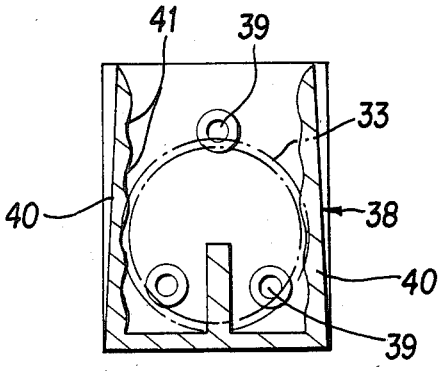
FIG. 8 is a vertical cross section taken through an end support bracket for a circular support bar.
Figure 9:
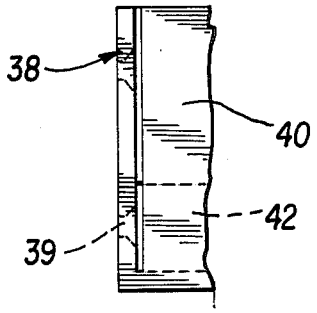
FIG. 9 is a fragmentary side elevation of the end support bracket.

FIGS. 8 and 9 show an end mounting bracket 38 for the round support bar 33. A pair of these brackets 38 can be installed with screws on any two spaced walls with the screws engaging through apertures 39 of the bracket 38. The inner faces of the bracket side walls 40 are fluted as at 41 to engage and grip the circular cross-section support bar 33 when the latter is pushed downwardly between the somewhat resilient walls 40. A center web 42 of the bracket 38 enters the space between the two rails 32 of the circular support bar 33. The web 42 prevents the installed circular bar 33 from turning and assures a vertical disposition of the carriers 10. The mounting bracket arrangement is convenient and secure.

It can be seen that the dual purpose wheeled carrier for shower curtains and draperies possesses many advantages over the prior art, is more convenient and has a better appearance than the prior art and is competitive in cost with the prior art. The wheeled carrier is durable and long lasting. The stitching of the tape 34 onto the drapery 36 provides a new approach to the installation of draperies which is more precise and requires much less labor and time of installation.

It is to be understood that the form of the invention herewith shown and described is to be taken as a preferred example of the same, and that various changes in the shape, size and arrangement of parts may be resorted to, without departing from the spirit of the invention or scope of the subjoined claims.

What is claimed is:

1. A carrier for a flexible closure comprising a body portion having hook terminals at opposite ends thereof, a pair of divergent spring arms on the body portion between said hook terminals, keeper means on the body portion engageable with the spring arms to releasably hold them in retracted substantially parallel positions, a dual wheel assembly including an axle portion having releasable snap-locked engagement with one of said hook terminals and being adapted to roll on a guide member, and a button unit including a shank insertable through an aperture means of a hanging flexible closure and further including an axle portion having releasable snap-locked engagement with the other hook terminal of said body portion.

2. A carrier for a flexible closure as defined in claim 1, and the dual wheel assembly having two axially spaced wheels intervened by said axle portion and straddling said one hook terminal.

3. A carrier for a flexible closure as defined in claim 1, and said body portion including said hook terminals, spring arms and keeper means being formed as a unit from somewhat resilient material.

4. A carrier for a flexible closure as defined in claim 3, and said body portion being molded from plastics material.

5. A carrier for a flexible closure as defined in claim 1, and a drapery support tape for use with said carrier having woven areas along its length adapted to be stitched to a drapery and having a series of raised tubular tape segments along its length through which pairs of said spring arms are insertable after being engaged from said keeper means to support a drapery on the carrier.

6. A carrier for a flexible closure as defined in claim 1, and an overhead hollow support bar for said carrier having laterally spaced rails on which the wheels of said dual wheel assembly roll with said body portion traversing the space between said rails and extending below said support bar.

7. A system for supporting a shower curtain or a drapery selectively comprising a vertically hanging body portion having a top wheeled unit adapted to traverse a guideway with the body portion suspended therebelow, drapery supporting spring arms on the body portion engageable through tubular tape segments on a drapery to support the drapery, keepers on the body portion to releasably hold the spring arms in a retracted position, wherein said spring arms are always substantially parallel when engaged by said keeper means, and a shower curtain button unit removably fitted into an opening in the bottom of said body portion below said spring arms and including a shank insertable through an opening in a shower curtain to support the shower curtain.

8. A carrier for a flexible closure comprising a body portion having hook terminals at opposite ends thereof, a pair of divergent spring arms on the body portion between said hook terminals, keeper means on the body portion engageable with the spring arms to releasably hold them in a retracted position, wherein said spring arms are always substantially parallel when engaged by said keeper means, a dual wheel assembly including an axle portion having releasable snaplocked engagement with one of said hook terminals and being adapted to roll on a guide member.

9. A carrier for a flexible closure as defined in claim 8, and a drapery support tape for use with said carrier having woven areas along its length adapted to be stitched to a drapery and having a series of raised tubular tape segments along its length through which pairs of said spring arms are insertable after being disengaged from said keeper means to support a drapery on the carrier.

10. A carrier for a flexible closure as defined in claim 8, and an overhead hollow support bar for said carrier having laterally spaced rails on which the wheels of said dual wheel assembly roll with said body portion traversing the space between said rails and extending below said support bar.

11. A carrier system for a flexible closure comprising a carrier, said carrier comprising a body portion having hook terminals at opposite ends thereof, a pair of divergent spring arms on the body portion between said hook terminals, keeper means on the body portion engageable with the spring arms to releasably hold them in a retracted parallel position, wherein said spring arms are always substantially parallel when engaged by said keeper means and, a dual wheel assembly including an axle portion having releasable snaplocked engagement with one of said hook terminals and being adapted to roll on a guide member, and a drapery support tape for use with said carrier having woven areas along its length adapted to be stitched to a drapery and having a series of raised tubular tape segments along its length through which pairs of said spring arms are insertable after being disengaged from said keeper means to support a drapery on the carrier.

* * * * *